US005433262A

United States Patent [19]

Kawaguchi et al.

[11] Patent Number: 5,433,262

[45] Date of Patent: Jul. 18, 1995

[54] METHOD FOR MANUFACTURING CASTING AND APPARATUS FOR MANUFACTURING A CASTING

[75] Inventors: Kenji Kawaguchi; Mikio Yamashita; Shigeki Maekawa, all of Amagasaki, Japan

[73] Assignee: Mitsubishi Denki Kabushiki Kaisha, Tokyo, Japan

[21] Appl. No.: 22,657

[22] Filed: Mar. 1, 1993

[30] Foreign Application Priority Data

| | | | |
|---|---|---|---|
| Mar. 4, 1992 | [JP] | Japan | 4-046774 |
| Aug. 5, 1992 | [JP] | Japan | 4-208926 |
| Nov. 30, 1992 | [JP] | Japan | 4-319878 |
| Feb. 15, 1993 | [JP] | Japan | 5-025387 |

[51] Int. Cl.[6] ..... B22D 27/11

[52] U.S. Cl. ..... 164/120; 164/319; 164/320

[58] Field of Search ..... 164/120, 319, 320

[56] References Cited

U.S. PATENT DOCUMENTS

| | | | |
|---|---|---|---|
| 4,314,955 | 2/1982 | Boden et al. . | |
| 4,760,300 | 7/1988 | Yoshida et al. | 310/211 |
| 5,067,550 | 11/1991 | Maekawa et al. | 164/120 |

FOREIGN PATENT DOCUMENTS

| | | | |
|---|---|---|---|
| 0144622 | 6/1985 | European Pat. Off. . | |
| 0236097 | 9/1987 | European Pat. Off. . | |
| 60-102262 | 6/1985 | Japan | 164/120 |
| 63-212057 | 9/1988 | Japan . | |
| 1177705 | 1/1970 | United Kingdom . | |
| 1239392 | 7/1971 | United Kingdom . | |
| 1299511 | 12/1972 | United Kingdom . | |

*Primary Examiner*—Kuang Y. Lin
*Attorney, Agent, or Firm*—Wolf, Greenfield & Sacks

[57] ABSTRACT

A process and an apparatus for manufacturing a cast product in which the cavity 2c is defined by a top die 1, a bottom die 2 and a slidable die insert 11 relative to the top die 1 and a pressure is applied to the die insert 11 by a hydraulic cylinder 13 before casting, injecting a molten metal 6 at a pressure higher than that on the die insert 11 to cause the die insert 11 to move rearward, whereby the molten metal 6 is additionally filled in the cavity 2c by an amount corresponding to the shrinkage due to pressurization, and a pressure on the molten metal 6 within the cavity 2c is maintained through the die insert 11 even after the molten metal 6 in the gate 2b has been solidified and the injection pressure has: not been transmitted anymore.

24 Claims, 8 Drawing Sheets

METHOD FOR MANUFACTURING CASTING AND APPARATUS FOR MANUFACTURING A CASTING

BACKGROUND OF THE INVENTION

This invention relates to a process and an apparatus for manufacturing a cast product and, more particularly, to a cast forging process and apparatus capable of manufacturing a machine component to which a high-strength is required, such as a scroll of a scroll compressor and a VTR drum without any fear of defect such as shrinkage cavities.

FIGS. *7a* and *7b* are schematic sectional views illustrating a conventional indirect insertion-type squeeze casting apparatus disclosed in "Illustrated Dictionary of Casting, Second Edition" P. 121, edited by Japanese Association of Casting, FIG. *7a* illustrating a state before casting and FIG. *7b* illustrating a state immediately after casting. In these figures, reference numeral 1 is a top die, 2 is a bottom die, *2a* is a molten metal reservoir disposed in the bottom die 2, *2b* and *2c* are a plurality of gates and cavities (a single cavity may be used), respectively, disposed between the top and the bottom dies 1 and 2, 3 is an extrusion plunger, 4 is a die-clamping ram attached to the top die 1, 5 is a knock-out punch, 6 is a molten metal and 7 is a solidified casing.

The operation will now be described. The top die 1 is firmly urged against and fastened to the bottom die 2 by the die-clamping ram 4. The molten metal 6 is supplied to the molten metal reservoir *2a* formed in the bottom die 2 immediately before the casting. In this state, the injection plunger 3 is moved downward to pressurize the molten metal 6. The injection plunger 3 continues to pressurize the molten metal 6 at a high pressure equal to or more than 500 atmospheric pressure until the molten metal 6 solidifies and casting is completed. Then, the injection plunger 3 is moved rearward (upward) and the top die 1 is moved upward by the die-clamping ram 4 to open the die and the cast product 7 can now been taken out from the die by moving the knock-out punch 5 upward. The gate sections *2b* are removed by a separate pressing step to obtain a cast product corresponding to the cavity portion *2c*.

FIGS. *8a* and *8b* illustrate a scroll member for use in a scroll compressor having a hollow boss portion, FIG. *8a* being a front view and FIG. *8b* being a sectional view taken along B—B line in FIG. *8a*. In these figures, reference numeral 40 is a scroll member for a scroll compressor, which has a scroll-shaped spiral teeth portion 40*a* on one side of a base plate portion 40*b* and a boss portion 40*c* axis-symmetrically formed on the other side of the base plate portion 40*b*. This is a component which requires a high precision of the order of μm.

FIG. 9 illustrates a schematic sectional view of an indirect insertion cast forging apparatus for casting the scroll member for the scroll compressor illustrated in FIGS. *8a* and *8b* based on the disclosure of "Illustrated Dictionary of Casting, Second Edition" P. 121, edited by Japanese Association of Casting, the left half illustrating the state before casting and the right half illustrating after casting. In the figure, reference numeral 1*c* is a gate disposed in the top die 1 and 1*d* is a cavity.

The operation will now be described. The top die 1 is firmly urged against and fastened to the bottom die 2 by the die-clamping ram 4. The molten metal 6 is supplied to the molten metal reservoir *2a* formed in the bottom die 2 immediately before the casting. In this state, the injection plunger 3 is moved upward to pressurize the molten metal 6. The molten metal 6 is introduced by the injection plunger 3 to the cavity 1*d* through the gate 1*c*. The injection plunger 3 continues to pressurize the molten metal 6 at a high pressure equal to or more than 500 atmospheric pressure until the molten metal 6 solidifies and casting is completed. Then, the die-clamping ram 4 is moved-upward to open the die 1, and the injection plunger 3 is moved upward and a connected cast product in the cavity 1*d* and the molten metal reservoir *2a* can now been taken out from the die. The gate sections 1*c* are removed by a separate step of sawing to obtain a cast product 40 corresponding to the cavity portion 1*d*.

As is well known, the cast forging process is a process in which a molten metal is injected into a die cavity at a low speed capable of maintaining a laminar flow to prevent the generation of cast cavities due to the trapped gas and in which a high pressure about 500 atmospheric pressure or more is kept being applied to the molten metal until it is solidified to prevent the generation of shrinkage cavities due to the volume shrinkage upon the solidification of the molten metal, the process being known as a process for obtaining a defect-free, quality cast product. However, while it is necessary to keep applying a high pressure until each corner of the molten metal in the die solidify in order to prevent the generation of the shrinkage cavities, in the case of the indirect insertion cast forging process illustrated in FIGS. *7a* and *7b*, the molten metal 6 flows through the gate *2b* to reach the cavity *2c* and solidifies therein, so that it is necessary that the molten metal within the gate *2b* does not solidify and stays in a molten state until the molten metal within the cavity *2c* solidifies in order that the high pressure applied to the molten metal 6 within the molten metal reservoir *2a* from the injection plunger 3 keeps being transmitted to the molten metal within the cavity *2c*. Also, the molten metal within a recessed portion at the center of the cavity *2c* in the illustrated example is required to solidify at a later time than the molten metal surrounding it. That is, in order to prevent the generation of the shrinkage cavity, it is necessary that a directional solidification in which the solidification is achieved progressively from the outer portion of the cavity *2c* toward the molten metal reservoir *2a* can be achieved. In order to achieve this, it is necessary that the gate *2b* has large dimensions, which leads to problems of requiring a machine cutting of the gate *2b* to obtain the cast product corresponding to the cavity *2c* after the casting 7 is taken out from the die because the press cutting provides a very poor surface conditions and dimensional accuracy of the cut surface. The second problem is the limited configuration of the product, in which the dimension of the thin-wall portion for example is limited because the molten metal which becomes a product in the cavity *2c* must be solidified from the outer portion toward the inner portion.

Further, in order to prevent generation of shrink cavities in the scroll member of the scroll compressor illustrated in FIGS. *8a* and *8b*, it is necessary that the directional solidification in which the solidification of the molten metal progresses from the outer portion of the cavity 1*d* toward the molten metal reservoir *2a* can be achieved as in the apparatus illustrated in FIG. 9. In order to achieve this, firstly, it is necessary that the gate 1*c* has large dimensions, which leads to problems of requiring a machine cutting of the gate 1*c* to obtain the cast product corresponding to the cavity 1*d* after the casting is taken out from the die because the press cutting provides a very poor surface conditions and dimensional accuracy of the cut surface. Secondly, with this configuration of the product, the shrink cavities in the base plate portion near the gate cannot completely be eliminated even when the gate thickness is made similar to the thickness of the base plate portion.

SUMMARY OF THE INVENTION

Accordingly, the present invention has been made in order to eliminate the above-discussed problems and has as its object the provision of a process for manufacturing a casting in which a small-dimensioned gate can be used without the fear of generating a shrink cavity in the product so that the gate portion can be very easily cut and in which the limitation on the product configuration can be significantly eliminated.

Another object of the present invention is to provide an apparatus for carrying out the above process.

With the above objects in view, according to the present invention, the method for manufacturing a casting by injecting and solidifying a molten metal within a cavity of a die is characterized by the steps of defining the cavity by a top die and a bottom die of the die and a die insert slidable relative to at least one of the top and bottom dies, moving the die insert rearward before injection to enlarge the cavity, and moving the die insert forward under a pressure equal to or less than an injection pressure before solidifying the molten metal within a gate portion for introducing the molten metal into the cavity.

Also, the pressure on the die insert is increased above the injection pressure after gate solidification.

Also, the cavity volume is increased by an amount corresponding to shrinkage of the molten metal.

Also, according to the present invention, the method for manufacturing a casting by injecting and solidifying a molten metal within a cavity of a die is characterized by the steps of defining the cavity by a top die and a bottom die of the die and a die insert slidable relative to at least one of the top and bottom dies, moving the die insert rearward during injection to enlarge the cavity, and moving the die insert forward under a pressure equal to or less than an injection pressure before solidifying the molten metal within a gate portion for introducing the molten metal into the cavity.

Also, the pressure on the die insert is increased above the injection pressure after gate solidification.

Also, the cavity volume is increased by an amount corresponding to shrinkage of the molten metal.

Also, according to the present invention, the method for manufacturing a casting by injecting and solidifying a molten metal within a cavity of a die is characterized by the steps of defining the cavity by a top die and a bottom die of the die and a die insert slidable relative to at least one of the top and bottom dies, and applying a pressure equal to or less than an injection pressure toward the cavity to the die insert before injection.

Also, the pressure on the die insert is increased above the injection pressure after gate solidification.

Also, the cavity volume is increased by an amount corresponding to shrinkage of the molten metal.

Also, the die insert is maintained at a predetermined position.

Also, the thick-wall portion of a cavity having a thick-wall portion and a thin-wall portion is provided by a die insert.

Further, according to the present invention, the apparatus for manufacturing a casting by injecting and solidifying a molten metal within a cavity of a die is characterized by the provision of a top die, a bottom die, a die insert slidable relative to at least one of the top and bottom dies for defining the cavity together with the top and bottom dies, means for stopping the forward movement of the die insert at a predetermined position and pressure means for applying a pressure to the die insert.

Also, according to the present invention, the apparatus for manufacturing a casting by injecting and solidifying a molten metal within a cavity of a die is characterized by the provision of a top die, a bottom die, a first die insert slidable relative to at least one of the top and bottom dies, a second die insert slidably disposed on the first die insert for defining the cavity together with the top and bottom dies and the first die insert, pressure means for simultaneously applying a pressure to the first and second die inserts, and drive means for driving the second die insert.

According to the method for manufacturing a casting of the present invention, the die insert slidable relative to at least one of the top and bottom dies is moved rearward before injection to enlarge the cavity and is moved forward under a pressure equal to or less than an injection pressure before solidifying the molten metal within a gate portion for introducing the molten metal into the cavity. Then, the molten metal does not flow reversely from the gate and, when the solidification in the cavity portion progresses and begins to shrink, the die insert starts to move forward due to the pressure applied on the die insert and applies a pressure to the molten metal within the cavity to reduce the volume of the cavity without impeding the forward movement of the die insert, thereby preventing shrink cavities. Therefore, a detect-free, quality cast product can be manufactured even with a small-dimension gate.

Also, by increasing the pressure applied on the die insert above the injection pressure after gate solidification at an appropriate timing, the reverse flow of the molten metal is prevented and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, by increasing the cavity volume by an amount corresponding to shrinkage of the molten metal when it is solidifies, the dimensions of the cast product which shrinks during the solidification can be finished at desired dimensions.

Also, according to the present invention, a die insert of the cavity portion which is slidable relative to at least one of the top and bottom dies is moved rearward during injection to enlarge the cavity and is moved forward under a pressure equal to or less than an injection pressure before solidifying the molten metal within a gate portion for introducing the molten metal into the cavity. Then, the molten metal does not flow reversely from the gate and, when the solidification in the cavity portion progresses and begins to shrink, the die insert starts to move forward due to the pressure applied on the die insert and applies a pressure to the molten metal within the cavity to reduce the volume of the cavity without impeding the forward movement of the die insert, thereby preventing shrink cavities. Therefore, a defect-free, quality cast product can be manufactured even with a small-dimension gate.

Also, by increasing the pressure applied on the die insert above the injection pressure after gate solidification at an appropriate timing, the reverse flow of the molten metal is prevented and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, by increasing the cavity volume by an amount corresponding to shrinkage of the molten metal when it is solidifies, the dimensions of the cast product which shrinks during the solidification can be finished at desired dimensions.

Also, according to the method for manufacturing a casting of the present invention, the die insert of the cavity portion slidable relative to at least one of the top and bottom dies is moved forward by applying thereto a pressure equal to or less than an injection pressure toward the cavity before injection. When injected, since the injection pressure is higher than the pressure applied to the die insert, the die insert of the cavity portion is moved rearward by being overcome by the molten,-metal pressure being injected into the cavity, whereby the volume of the cavity is increased. When the molten metal within the small-dimensioned gate portion is solidified, the pressure from the extraction plunger is blocked at the gate portion and not transmitted to the molten metal within the cavity. However, the pressure previously applied to the die insert is applied to the molten metal within the cavity, and at the instant when .the shrinkage of the cavity portion starts due to the progressive solidification of the cavity portion, the die insert starts to move forward due to the pressure applied to the die insert, reducing the volume of the cavity by pressurizing the molten metal within the cavity portion by an amount corresponding to the shrinkage due to the solidification, whereby the generation of the shrink cavities can be prevented. Therefore, a defect-free, quality cast product can be manufactured even with a small-dimension gate.

Also, by increasing the pressure applied on the die insert above the injection pressure after gate solidification at an appropriate timing, the reverse flow of the molten metal is prevented[and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, by increasing the cavity volume by an amount corresponding to shrinkage of the molten metal by rearwardly moving the die insert when the molten metal is being injected, the dimensions of the cast product which shrinks during the solidification can be finished at desired dimensions.

Also, the die insert is made forwardly movable by an amount corresponding to shrinkage of the molten metal, and the die insert is maintained at a predetermined position, so that the dimensions of the cast product which shrinks during the solidification can be finished at a higher precision.

Also, according to the method for manufacturing a cast product of the present invention, the thick-wall portion of the cavity having the thick-wall portion and the thin-wall portion is provided by the die insert, so that the die insert can be smoothly moved forward under pressure without impeding the forward movement of the die insert by the thin-wall portion which solidifies quickly, whereby a defect-free, quality cast product can be manufactured even with a small-dimension gate.

Further, according to the apparatus for manufacturing a casting of the present invention, there are provided means for stopping the forward movement of the die insert of the cavity portion slidable relative to at least one of the top and the bottom dies at a predetermined position and pressure means for applying a pressure to the die insert, so that the above manufacturing method can be easily and efficiently carried out.

Also, according to the apparatus for manufacturing a casting of the present invention, there is provided drive means for driving the second die insert to extrude the cast product staying on the die including the die insert, so that the cast product can be easily taken out from the die including the die insert, eliminating the plastic deformation during the separation and providing a product having a good appearance.

DESCRIPTION OF THE PREFERRED EMBODIMENTS

Embodiment 1

Figure 1:
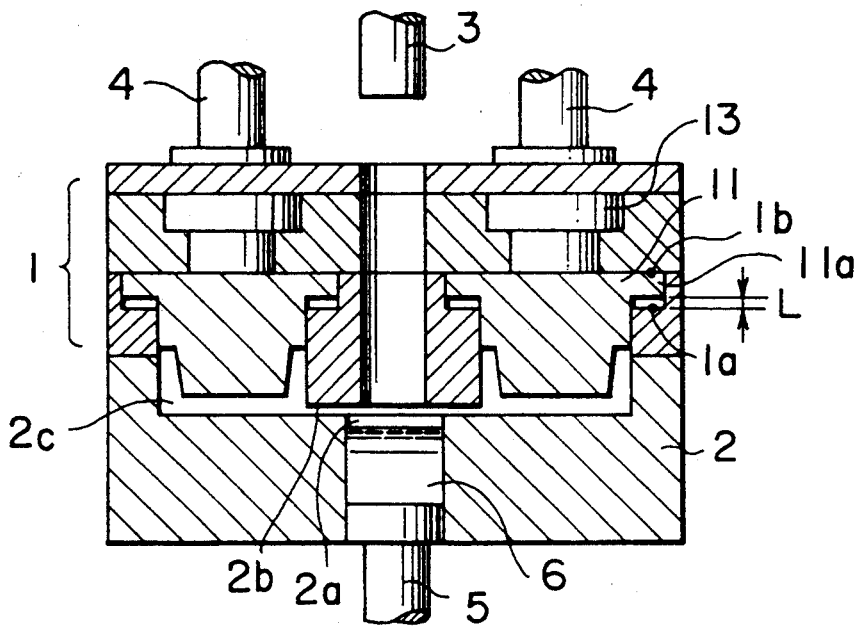
FIG. 1 is a sectional structural view illustrating one embodiment of the apparatus for manufacturing a casting of the present invention.

One embodiment of the present invention will now be described in conjunction with the drawings. FIG. 1 is a sectional structural view of one embodiment of an apparatus for manufacturing a casting of the present invention. In the figure, reference numeral 11 is a die insert slidably embedded within a top die 1, the top die 1, together with a bottom die 2, constituting a cavity 2*c*, and has formed at its top end a flange 11*a* constituting a forward engagement means. Here, the forward engagement means refers to one example of means for stopping the forward movement of the die insert at a predetermined position. 13 is pressure applying means for applying a pressure to the die insert 11 and is a hydraulic cylinder in this case. Also, 1*a* is a forward engagement portion of the forward engagement means disposed on the top die 1 for being engaged by the flange 11*a* of the die insert 11 to support the weight of the die insert 11 when no load is applied to the die insert 11, and the forward engagement portion la prevents the die insert 11 from being further forwardly moved by the load from the hydraulic cylinder 13 in order that the gate 2*b* is not closed and the filling of the molten metal. 6 is not impeded and that the volume of the cavity 2*c* is not smaller than the product (casting). 1*b* is a rearward engagement portion of the rearward engagement means formed on the top die 1, which abuts against the back surface (the surface opposite to the cavity-opposing surface) of the die insert 11 to prevent the rearward movement of the die insert 11 more than the amount corresponding to the shrinkage due to the pressurizing of the molten metal 6. Here, the rearward engagement means refers to one example of means for stopping the die insert at the position where the cavity volume is increased by an amount corresponding to the shrinkage of the molten metal in timing of the injection. L is a pressure margin defined between the top die 1 and the die insert 11 and having dimensions corresponding to the volume shrinkage of the molten metal of the cavity 2*c* portion. In this embodiment, the sliding movement distance of the die insert 11 is limited to the pressure margin L defined by the forward engagement portion 1*a* and the rearward engagement portion 1*b*. It is to be noted that the dimension of the gate 2*b* is smaller than that used in the conventional cast forging process in order to make cutting easier.

The operation will now be described. Before the injection, the die insert 11 is urged toward the cavity by a hydraulic cylinder 13 under a pressure equal to or less than the injection pressure. Then, the die insert 11 under pressure is at a low position in which the flange 11*a* abuts against the forward engagement portion 1*a* and in which the pressure margin L is zero, i.e., the die insert 11 is in a predetermined position corresponding to a finish dimension of the cast product. Then, the molten metal 6 is poured into the molten metal reservoir 2*a* in the bottom die 2, the injection plunger 3 is lowered to inject under pressure the molten metal 6 through the gate 2*b* into the cavity 2*a*. At this time, the pressure applied to the molten metal 6 by the injection plunger 3 is equal to or higher than the pressure applied to the die insert 11 by the hydraulic cylinder 13. When the cavity 2*c* is filled with the molten metal 6, the die insert 11 pressurized by the hydraulic cylinder 13 is caused to recede or move rearward due to the pressure of the molten metal 6 until the die insert 11 abuts against the rearward engagement portion 1*b* of the top die 1 and the pressure margin L returns to L. That is, in this state, the volume of the cavity 2*c* is increased by an amount corresponding to the shrinkage of the molten metal 6 due to the pressurization. The solidification occurs first at the gate 2*b* which is small in dimensions, and the high pressure supplied to the molten metal 6 from the injection plunger 3 is blocked at the gate 2*b* and is not transmitted to the cavity 2*c*. Therefore, the molten metal 6 in the cavity 2*c* is not pressurized and is apt to solidify and shrink without any additional supply of the molten metal 6 from the molten metal reservoir 2*a*. However, since the die insert 11 is still maintained under pressure by the hydraulic cylinder 13, the die insert 11 moves downward at this instant to crash any shrink cavity which is about to generate within the cavity 2*c*. This phenomenon automatically continues until the molten metal 6 in the cavity 2*c* completely solidifies, whereby the solidification without any shrink cavity can be completed. Since the pressure margin L is determined in correspondence with the solidification shrinkage which depends upon the metal or alloy material, the die insert 11 after the solidification is in the state before casting in which the pressure margin L between the die insert 11 and the top die 1 is zero. When the molten metal 6 has completely solidified, the casting is completed and the injection plunger 3 as well as the clamping ram 4 is moved upward to open the die. The cast product can now be taken out by ascending the knock-out punch 5.

According to the present invention, no shrink cavity is generated even with a small gate portion dimension and a defect-free product can be obtained. Also, since the gate portion is small in dimension, the gate can be very easily cut in the subsequent step and the cut allowance for finishing can be made small. Further, since the pressure applied by the hydraulic cylinder 13 through the die insert 11 acts continuously upon the molten metal within the cavity 2*c* until the molten metal completely solidifies to crash any shrink cavity which is about to generate even after the solidification of the molten metal within the gate 2*b*, no shrink cavity is generated even if the gate configuration in which the directional solidification can be achieved is not used, and the limitation on the configuration of the thin-walled portion of the product is significantly moderated to advantageously increase the degree of freedom in design. Further, since the die insert 11 is put under pressure beforehand, the pressure acts upon the molten meal within the cavity 2*c* through the die insert 11 at the instant of solidification of the molten metal in the gate portion 2*b*, eliminating the need for determining the timing of applying the pressure and no delay in pressurization takes place.

Whether or not the mechanism including the die insert 11 should be disposed in the top die 1 or the bottom die 2 or both is determined depending upon whether or not the portion which generates the shrink cavity due to the cavity configuration can be pressurized because the shrink cavity generates in the portion where the solidification takes place late.

Also, since a pressure of the order of about 500 atmospheric pressure is generally necessary to prevent the generation of shrink cavities in the cast forging process, it is preferable that the pressure to be applied to the die insert 11 is about the above value or higher. In this embodiment, the hydraulic pressure 13 applies a pressure of about 500 atmospheric pressure and the injection plunger 3 applies a pressure of about 800 atmospheric pressure.

Also, in the above embodiment, the pressure on the die insert may be increased higher than the injection pressure after the gate solidification. It may be increased from 500 atmospheric pressure to 1,000 atmospheric pressure, for example.

Also, in the above embodiment, the cavity volume is increased by an amount corresponding to the shrinkage of the molten metal, but if the dimensional accuracy of the finished product is not very much required, the arrangement may be such that the die insert simply moves rearward by an amount equal to or larger than the pressure margin.

Also, in the above embodiment, if the dimensional accuracy of the finished product is not very much required or if the downwardly moved die insert 11 does not close the gate portion 2*b* and obstacles the flow of the molten metal 6 into the cavity 2*c*, the forward engagement portion la can be lowered toward the bottom die 2 so that the die insert may be moved over a distance larger than the pressure margin.

Also, while the die insert 11 is pressurized by the hydraulic cylinder 13 before the injection of the molten metal 6 in the above embodiment, the die insert 11 may be receded before the injection to provide a larger cavity 2*c* and, upon the detection of the filling of the cavity 2*c* by the molten metal 6 such as by detecting the pressure on the injection plunger 3, the hydraulic cylinder 13 may be actuated, allowing similar advantageous results to be obtained. If the dimensional accuracy is not very much required, the arrangement may be such that the die insert simply moves rearward by an amount equal to or larger than the pressure margin.

Also, while the die insert 11 is pressurized by the hydraulic cylinder 13 during the injection of the molten metal 6 in the above embodiment, the die insert 11 may be receded during the injection to provide a larger cavity 2*c* and, upon the detection of the filling of the cavity 2*c* by the molten metal 6 such as by detecting the pressure on the injection plunger 3, the hydraulic cylinder 13 may be actuated, allowing similar advantageous results to be obtained. If the dimensional accuracy is not very much required, the arrangement may be such that the die insert simply moves rearward by an amount equal to or larger than the pressure margin.

Embodiment 2

Figure 2:
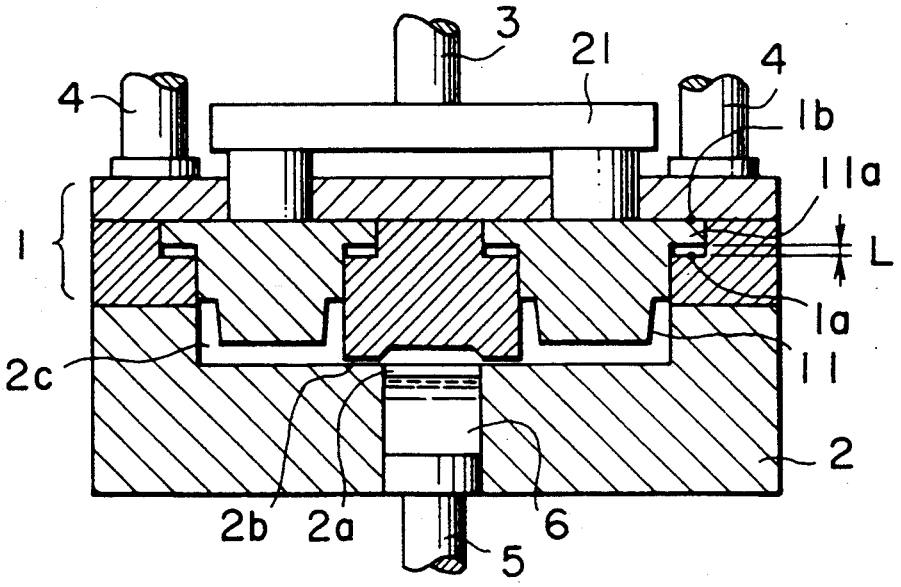
FIG. 2 is a sectional structural view illustrating the second embodiment of the apparatus for manufacturing a casting of the present invention.

FIG. 2 is a sectional view illustrating the apparatus for manufacturing a casting of the second embodiment of the present invention. In this embodiment, the pressurizing means is composed of the injection plunger 3 and the pressure plate 21 secured to the injection plunger 3, and the die insert 11 is pressurized by the injection plunger 3 through the pressure plate 21. The knock-out punch 5 in this embodiment also serves as the injection plunger 3 of the first embodiment and also serves to pressurize the molten metal 6 injected within the molten metal reservoir 2*a*. Although the injection plunger 3 has a different function and the knock-out punch 5 has a dual function, the operation is quite similar to that of the first embodiment and provides similar advantageous results.

While the pressure margin L is defined between the top die 1 and the die insert 11 in this embodiment, it may equally be defined between the pressure plate 21 and the unillustrated cast machine main body.

Embodiment 3

Figure 3:
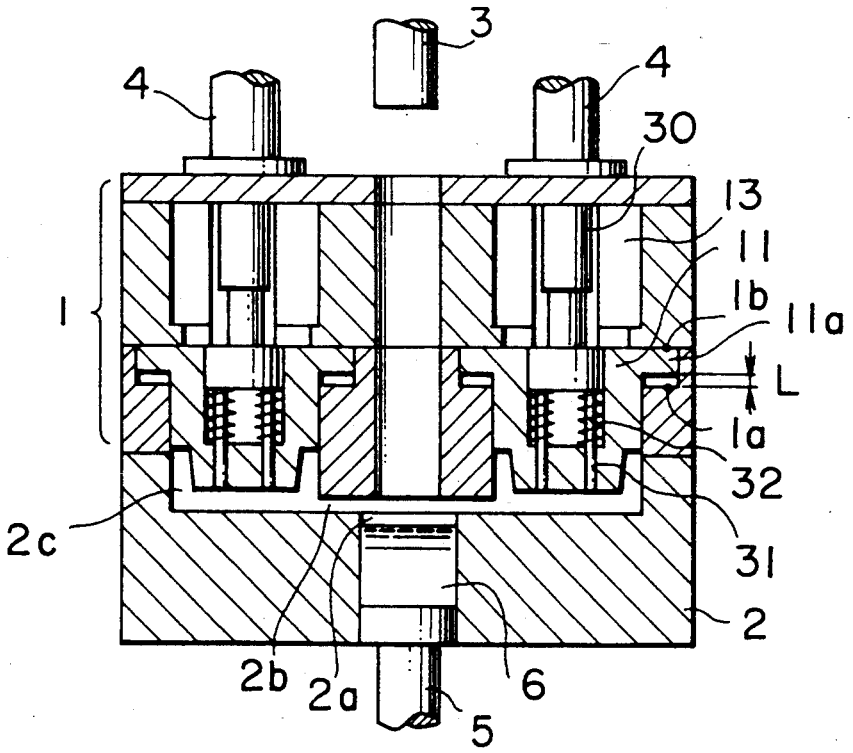
FIG. 3 is a sectional structural view illustrating the third embodiment of the apparatus for manufacturing a casting of the present invention.

FIG. 3 is a sectional structural view of the third embodiment of an apparatus for manufacturing a casting of the present invention. In the figure, reference numeral 13 is a hydraulic cylinder which is a pressure applying means, 30 is an ejection hydraulic cylinder disposed within the hydraulic cylinder 13 and having a long stroke for separation, and 31 are ejector pins of ejection jigs for transmitting the force from the ejection hydraulic cylinder 30 disposed within the die insert 11 to the cast product. Here, the ejector pins of the ejection jig are one example of a second die insert. Reference numeral 32 are compression springs for the ejection jig for maintaining the ejector pins 31 at a predetermined position (in the same plane as the cavity defining surface) and, in this case, for urging the ejector pins 31 against the upper engagement portion. In this embodiment, the ejection hydraulic cylinder 30, the ejector pins 31 and the springs 32 for the ejection jig constitutes ejection means. Further, the ring-shaped hydraulic cylinder 13 of the pressure-applying means is means for simultaneously applying a pressure to the die insert 11 which is one example of the first die insert and the ejector pins 31 of the ejection jig which is one example of the second die insert, and the ejection hydraulic cylinder 30 is means for driving the ejector pins 31 of the ejection jig which is one example of the second die insert.

The operation will now be described. The casting step is quite similar to that of the first embodiment. The difference resides in the cast product separation process after the casting. In the first embodiment, the description has been made as to the separating method by the knock-out punch 5 on the premises that the case product stays on the bottom die, there are many cases in which the cast product remains on the top die 1 (die insert-side die). Therefore, in this embodiment, the ejection hydraulic cylinder 30 having a longer stroke is disposed within the ring-shaped hydraulic cylinder 13, so that the cast product can be ejected and taken out from the top die including the die insert 11 by the ejector pins 31 after opening the die. The springs 32 for the ejection jig are for preventing the ejector pins 31 from lowering below a predetermined position or below the cavity-defining surface of the die insert 11 during casting and are in the compressed state.

With the embodiment of the apparatus for manufacturing a casing of the present invention, since the double cylinder mechanism having a dual function of the pressurization and the ejection, even when the case product remains on the die insert-side die, the separation from the die is easy, the plastic deformation during the separation can be eliminated and a casting having a good inner property and outer surface can be manufactured with a high productivity.

Embodiment 4

Figure 4:
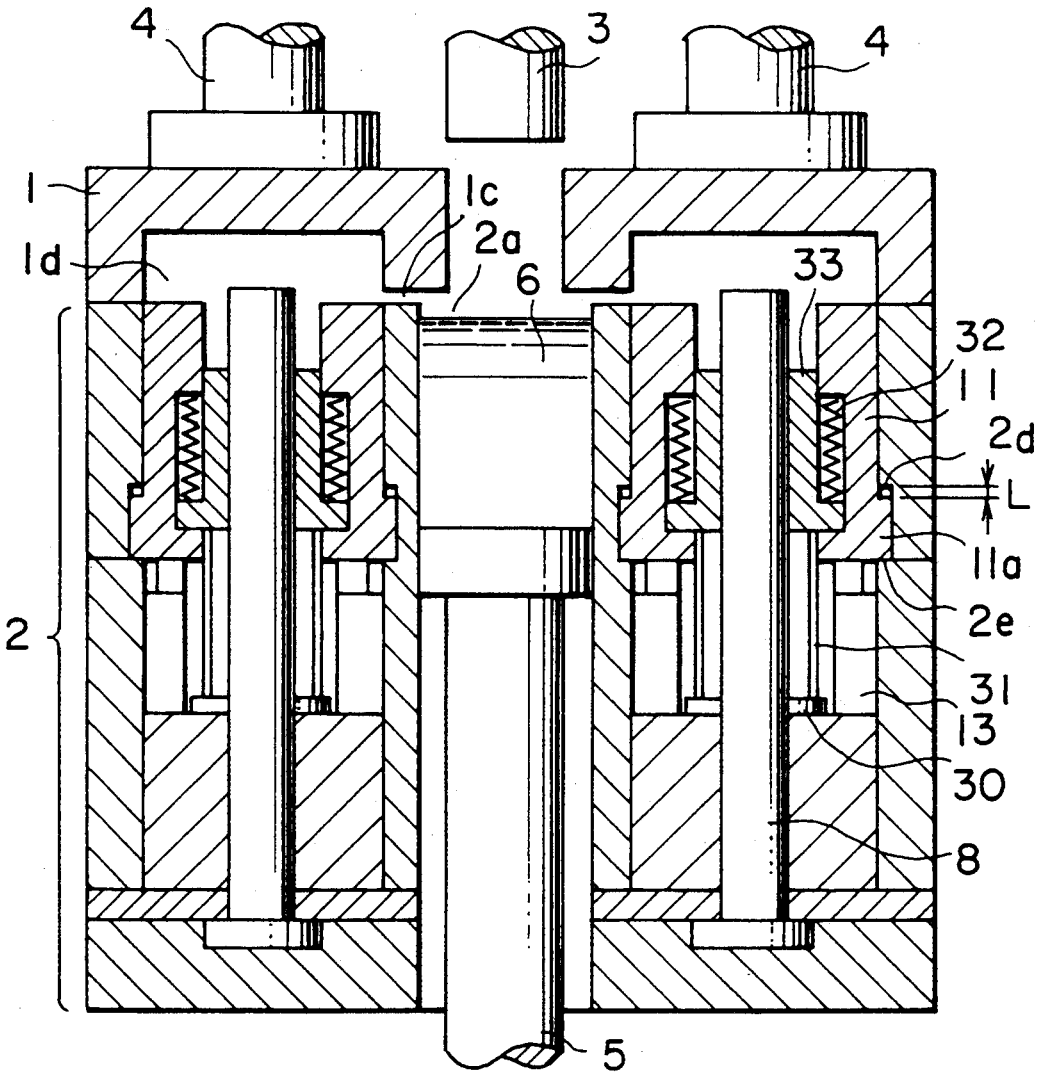
FIG. 4 is a sectional structural view illustrating the fourth embodiment of the apparatus for manufacturing a casting of the present invention.

FIG. 4 is a sectional structural view of the fourth embodiment of an apparatus for manufacturing a casting of the present invention. In the figure, reference numeral 1*c* is the gate, 1*d* is the cavity, 2*d* is the forward engagement portion of the forward engagement means disposed to the bottom die 2 for being engaged by the flange 11*a* of the die insert 11 to prevent the die insert 11 from being further forwardly moved by the load from the hydraulic cylinder 13 in order that the gate 1*c* is not closed and the filling of the molten metal 6 is not impeded and that the volume of the cavity 1*d* is not smaller than the product (casting). Here, the ejector ring 33 of the ejection jig is one example of the second die insert. 2*e* is a rearward engagement portion of the rearward engagement means formed on the bottom die 2, which abuts against the back surface (the surface opposite to the cavity-opposing surface) of the die insert 11 to prevent the rearward movement of the die insert 11 more than the amount corresponding to the shrinkage due to the pressurizing of the molten metal 6. 8 is a die insert for defining the inner diameter of the boss constituting one portion of the product, 33 are ejector rings constituting one portion of the cavity (the entire lower surface of the boss) for the ejection through the ejector pins 31, and 32 are springs for the ejection jig for lowering the ejector rings 33 to a predetermined position. The ejector ring 33, in other words, constitutes one portion of the die insert and, during the casting, operates in synchronization with the die insert 11 to achieve the same function and, during the separation, operates independently of the die insert 11 to eject the cast product. In this embodiment, ejection hydraulic cylinder 30, the ejector pins 31, the springs 32 for the ejection jig and the ejector rings 33 together constitute ejecting means. The ring-shaped hydraulic cylinder 13 of the pressure-applying means is means for simultaneously applying a pressure to the die insert 11 which is one example of the first die insert and the ejector rings 33 of the ejection jig which is one example of the second die insert, and the ejection hydraulic cylinder 30 is means for driving the ejector rings 33 of the ejection jig which is one example of the second die insert.

The operation will now be described. The casting step is similar to that of the third embodiment. The difference resides in the cast product separating step after the casting. In the third embodiment, since the cast product has a simple configuration and a broad ejecting surface, the case product can be ejected and separated from the die by the ejector pins 31 themselves. However, when the cast product of a complex configuration is to be manufactured as in this embodiment, the ejection surface is limited because there is a risk of generating a defect such as cracks in the root of the boss portion during the separation if the wide base plate portion is pushed. That is, the boss portion which has only a narrow ejection surface is the only portion that can be pushed for ejection. However, the ejection by the ordinary pin is difficult because of mechanical strength. Therefore, as illustrated in FIG. 4, the ejection hydraulic cylinder 30 having a long stroke is disposed inside of the ring-shaped hydraulic cylinder 13 and, after opening the die, the cast product which remains in the bottom die is ejected and taken out therefrom by the ejector ring 33 which abuts against the entire lower surface of the boss portion through the ejector pins 31. By pushing the entire lower surface of the boss portion in this manner, a cast product which is free from the shrink cavity and internally good quality can be manufactured without damaging the external quality. The spring 32 for the ejection jig, which is for preventing the ejector ring 33 from ascending from the predetermined lower position during casting, is compressed before casting.

Embodiment 5

Figure 5:
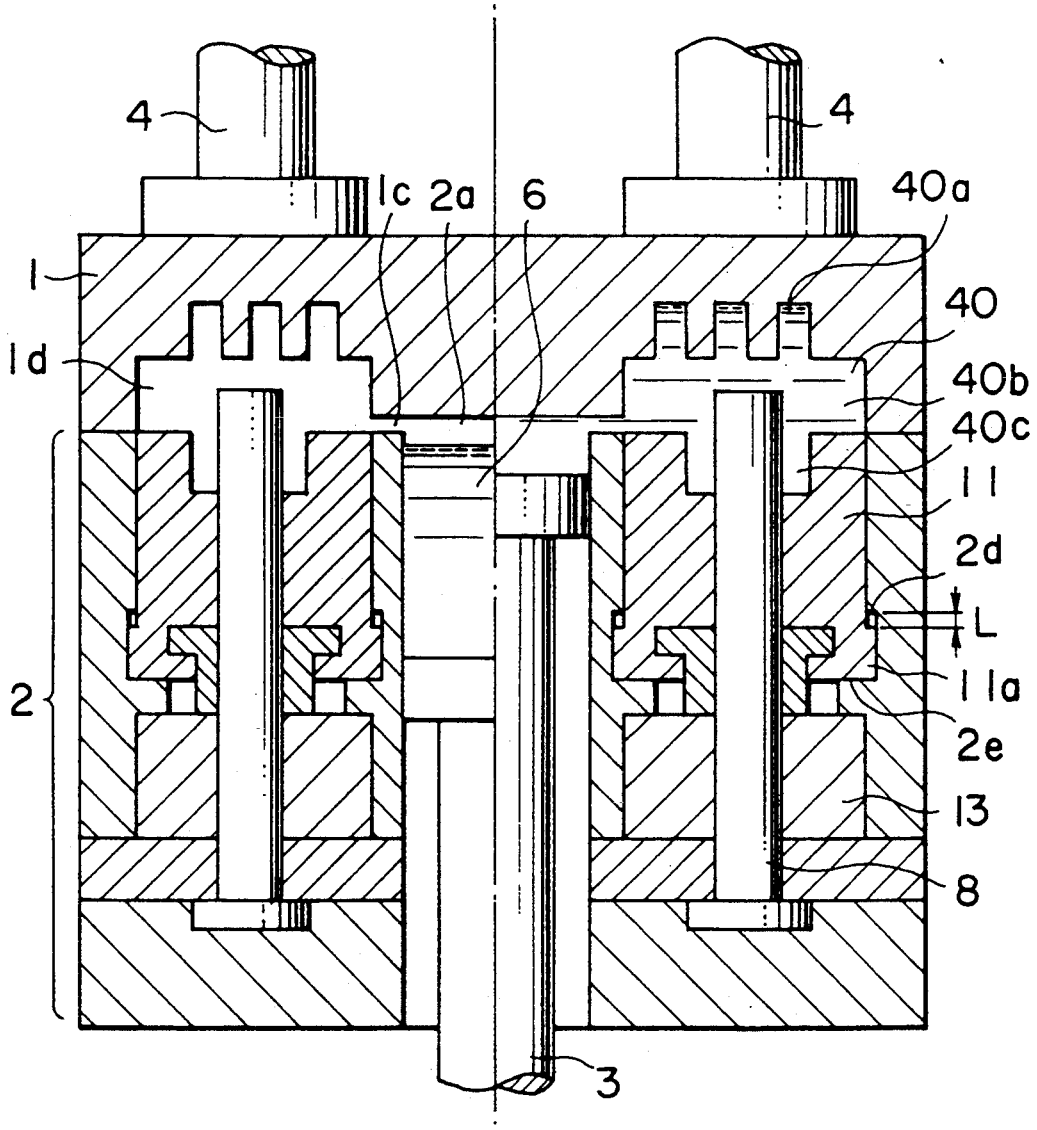
FIG. 5 is a sectional structural view illustrating the fifth embodiment of the apparatus for manufacturing a scroll member of the scroll compressor of the present invention.

FIG. 5 is a sectional structural view of an apparatus for casting a scroll member for scroll compressor which is the fifth embodiment of the present invention, the lefthand-half illustrates the state before casting and the righthand-half illustrates the state after casting. In the figure, reference numeral 1*c* is the gate, 1*d* is the cavity, 2*d* is the forward engagement portion of the forward engagement means disposed to the bottom die 2 for being engaged by the flange 11*a* of the die insert 11 defining the cavity on the side of the boss portion 40*c* to prevent the die insert 11 from being further forwardly moved in order that the gate 1*c* is not closed and the filling of the molten metal 6 is not impeded and that the volume of the cavity 1*d* is not smaller than the product (casting). 2*e* is a rearward engagement portion of the rearward engagement means formed on the bottom die 2, which abuts against the back surface (the surface opposite to the cavity-opposing surface) of the die insert 11 to prevent the rearward movement of the die insert 11 more than the amount corresponding to the shrinkage due to the pressurizing of the molten metal 6. 8 is a die insert (fixed) for defining the inner diameter of the boss constituting one portion of the product, L is a pressure margin defined between the bottom die 2 and the die insert 11 and having dimensions corresponding to the volume shrinkage of the molten metal of the cavity 1*d* portion. In this embodiment, the sliding movement distance of the die insert 11 is limited to the pressure margin L defined by the forward engagement portion 2*d* and the rearward engagement portion 2*e*. It is to be noted that the dimension of the gate 1*c* is smaller than that used in the conventional cast forging process in order to make cutting easier.

The operation will now be described. Before the injection, the die insert 11 is urged toward the cavity by a hydraulic cylinder 13 under a pressure equal to or less than the injection pressure. That is, the die insert 11, which defines an outer circumferential thick-wall portion of the base plate portion 40*b* except for a central thin-wall portion of the base plate portion 40*b* defined by the top end of the boss inner diameter die insert 8 (fixed), is moved upward until its flange 11*a* abuts against the forward engagement portion 2*d* to make the pressure margin L zero in FIG. 5. Then, the molten metal 6 is poured into the molten metal reservoir 2*a* in the bottom die 2, the injection plunger 3 is moved upward to inject under pressure the molten metal 6 through the gate 1*c* into the cavity 1*d*. At this time, the pressure applied to the molten metal 6 by the injection plunger 3 is equal to or higher than the pressure applied to the die insert 11 by the hydraulic cylinder 13. When the cavity 1*d* is filled with the molten metal 6, the die insert pressurized by the hydraulic cylinder 13 is caused to recede or moved rearward due to the pressure of the molten metal 6 until the die insert 11 abuts against the rearward engagement portion 2*e* of the bottom die 2 and the pressure margin L returns to L. That is, in this state, the volume of the cavity 1*d* is increased by an amount corresponding to the shrinkage of the molten metal 6 due to the pressurization. The solidification occurs first at the gate 1*c* which is small in dimensions, and the high pressure supplied to the molten metal 6 from the injection plunger 3 is blocked at the gate 1*c* and is not transmitted to the cavity 1*d*. Therefore, the molten metal 6 in the cavity 1*d* is not pressurized and is apt to solidify and shrink without any additional supply of the molten metal 6 from the molten metal reservoir 2*a*. However, since the die insert 11 is still maintained under pressure by the hydraulic cylinder 13, the die insert 11 moves downward at this instant to crash any shrink cavity which is about to generate within the cavity 1*d*. This phenomenon automatically continues until the molten metal 6 in the cavity 1*d* completely solidifies, whereby the solidification without any shrink cavity can be completed. Since the pressure margin L is determined in correspondence with the solidification shrinkage which depends upon the metal or alloy material, the die insert 11 after the solidification is in the state before casting in which the pressure margin L between the die insert 11 and the top die 1 is zero. When the molten metal 6 has completely solidified, the casting is completed and the injection plunger 3 as well as the clamping ram 4 is moved upward to open the die, and the cast product can now be taken out by ascending the injection plunger 3 which also functions as a knock-out punch.

According to the present invention, no shrink cavity is generated even with a small gate portion dimension and a defect-free product can be obtained. Also, since the gate portion is small in dimension, the gate can be very easily cut in the subsequent step and the cut allowance for finishing can be made small. Further, since the pressure applied by the hydraulic cylinder 13 through the die insert 11 acts continuously upon the molten metal within the cavity 1*d* until the molten metal completely solidifies to crash any shrink cavity which is about to generate even after the solidification of the molten metal within the gate 1*c*, no shrink cavity is generated even if the gate configuration in which the directional solidification can be achieved is not used like the scroll member of the scroll compressor of this embodiment. Further, since the die insert 11 is put under pressure beforehand, the pressure acts upon the molten meal within the cavity 1*d* through the die insert 11 at the instant of solidification of the molten metal in the gate portion 1*c*, eliminating the need for determining the timing of applying the pressure and no delay in pressurization takes place.

For separation from the die, an ejector means such as used in the fourth embodiment illustrated in FIG. 4 may be provided to push the upper surface of the boss portion, whereby the generation of defects such as cracks at the root portion of the boss during the separation can be prevented and a scroll member for a scroll compressor which is good also in external appearance can be obtained.

Also, since a pressure of the order of about 500 atmospheric pressure is generally necessary to prevent the generation of shrink cavities in the cast forging process, it is preferable that the pressure to be applied to the die insert 11 is about the above value or higher. In this embodiment, the hydraulic cylinder 13 applies a pressure of about 700 atmospheric pressure and the injection plunger 3 applies a pressure of about 1,000 atmospheric pressure.

Also, in the above embodiment, the pressure on the die insert may be increased higher than the injection pressure after the gate solidification. It may be increased from 700 atmospheric pressure to 1,500 atmospheric pressure, for example.

Also, in the above embodiment, the cavity volume is increased by an amount corresponding to the shrinkage of the molten metal, but if the dimensional accuracy of the finished product is not very much required, the arrangement may be such that the die insert simply moves rearward by an amount equal to or larger than the pressure margin.

Also, in the above embodiment, if the dimensional accuracy of the finished product is not very much required or if the downwardly moved die insert 11 does not close the gate portion 1*c* and obstructs the flow of the molten metal 6 into the cavity 1*d* , the forward engagement portion 1*a* can be placed at a higher position and above the top die 1 so that the die insert may be moved over a distance larger than the pressure margin.

Also, while the die insert 11 is pressurized by the hydraulic cylinder 13 before the injection of the molten metal 6 in the above embodiment, the die insert 11 may be receded before the injection to provide a larger cavity 1*d* and, upon the detection of the filling of the cavity 1*d* by the molten metal 6 such as by detecting the pressure on the injection plunger 3, the hydraulic cylinder 13 may be actuated, allowing similar advantageous results to be obtained. Also, the pressure on the die insert may be increased above the injection pressure after the gate solidification. If the dimensional accuracy is not very much required, the arrangement may be such that the die insert simply moves rearward by an amount equal to or larger than the pressure margin.

Also, while the die insert 11 is pressurized by the hydraulic cylinder 13 before the injection of the molten metal 6 in the above embodiment, the die insert 11 may be receded during the injection to provide a larger cavity 1*d* and, upon the detection of the filling of the cavity 1*d* by the molten metal 6 such as by detecting the pressure on the injection plunger 3, the hydraulic cylinder 13 may be actuated, allowing similar advantageous results to be obtained. Also, the pressure on the die insert may be increased above the injection pressure after the gate solidification. If the dimensional accuracy is not very much required, the arrangement may be such that the die insert simply moves rearward by an amount equal to or larger than the pressure margin.

Embodiment 6

Figure 6:
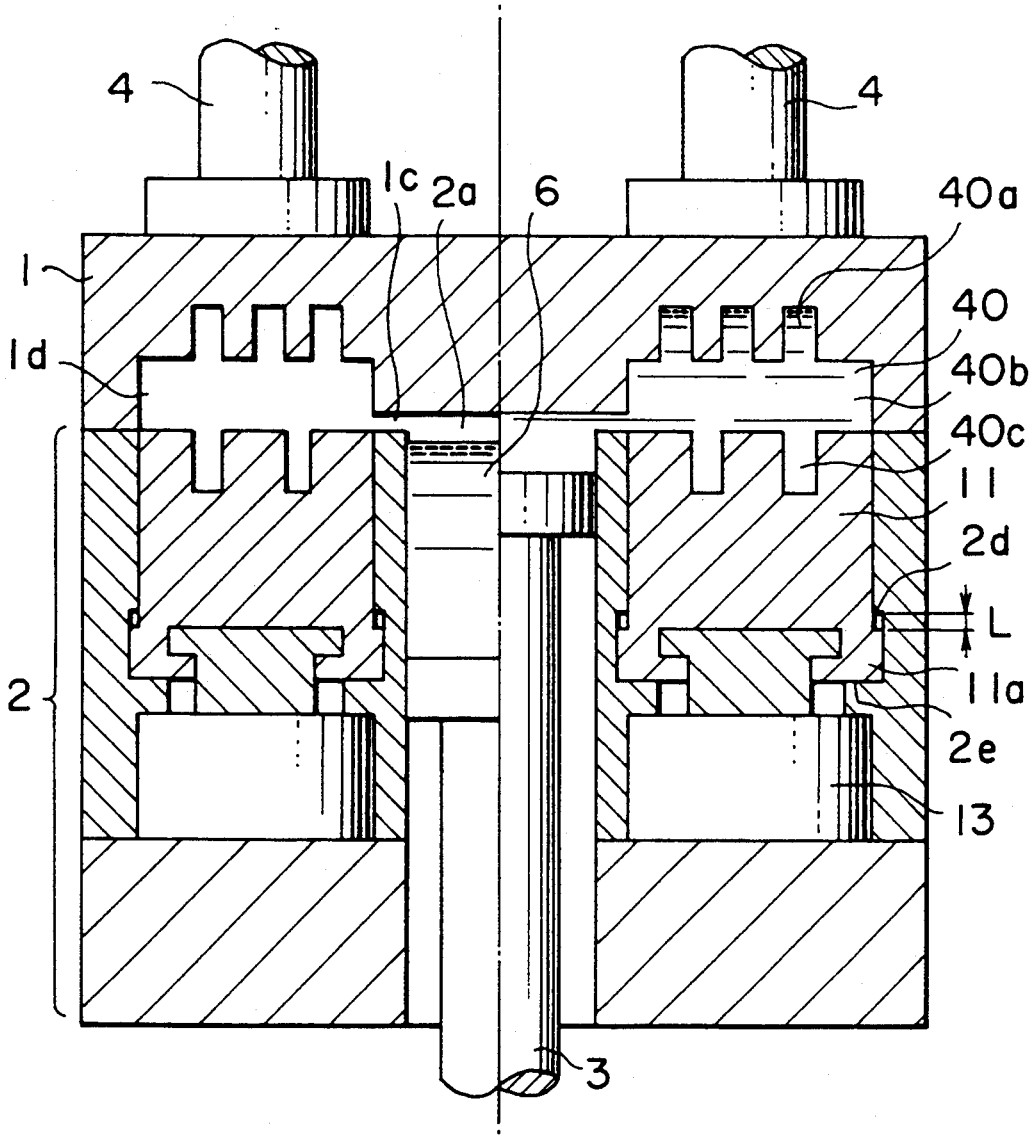
FIG. 6 is a sectional structural view illustrating the sixth embodiment of the apparatus for manufacturing a scroll member of the scroll compressor of the present invention.
Figure 7A:
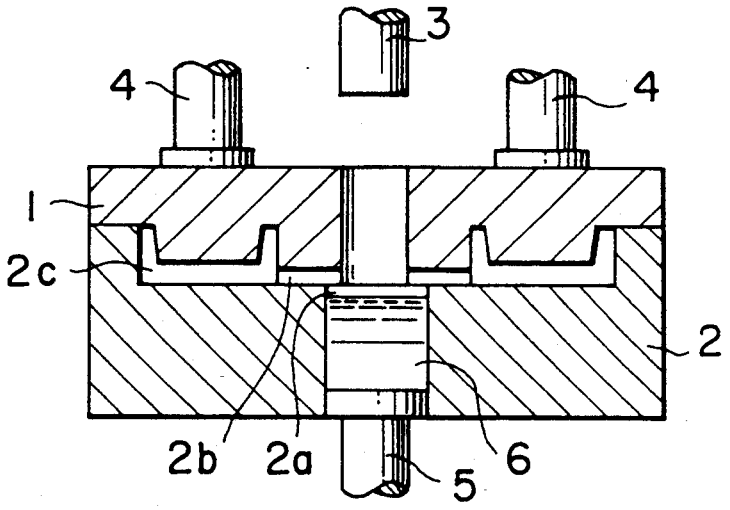
FIGS. 7*a* and 7*b* are schematic sectional views of a conventional indirect insertion-type squeeze casting apparatus in a state before and after casting, respectively.
Figure 7B:
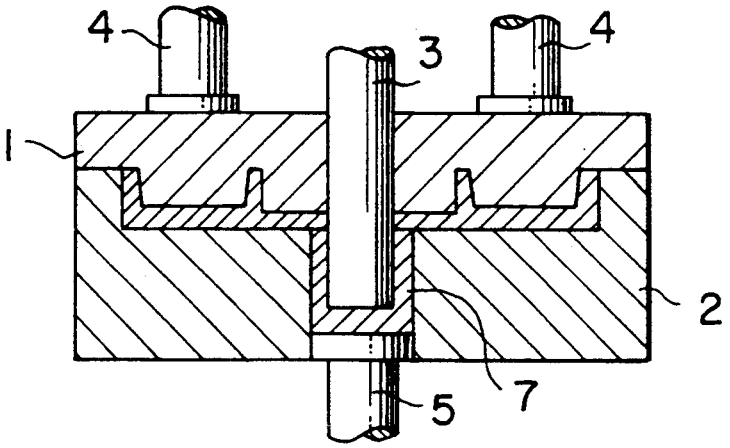
Figure 8A:
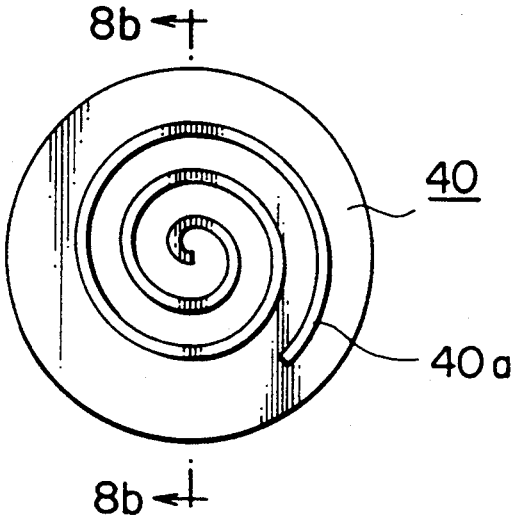
FIGS. 8*a* and 8*b* are a front view and a sectional view taken along line B—B, respectively, of a scroll member for use in a scroll compressor having a hollow boss portion.
Figure 8B:
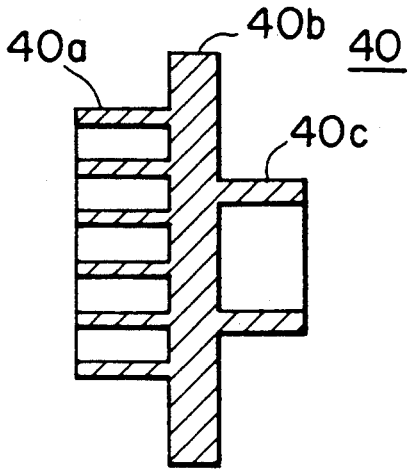
Figure 9:
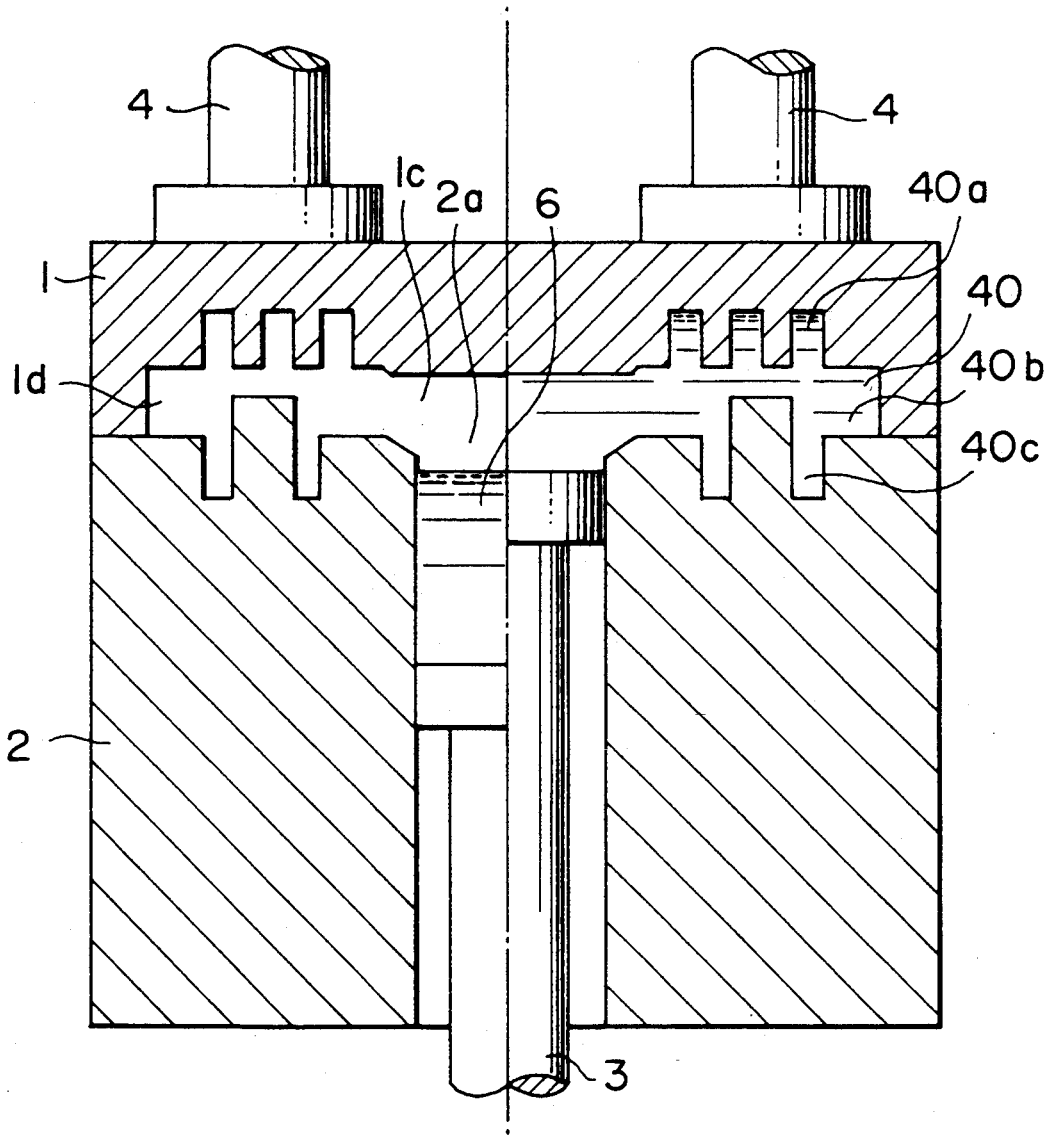
FIG. 9 a sectional structural view illustrating a conventional apparatus for manufacturing a scroll member of the scroll compressor.

FIG. 6 is a sectional view illustrating the apparatus for manufacturing a scroll member of a scroll compressor which is a sixth embodiment of the present invention. As for the operation, the casting step is identical to that of the fifth embodiment. The difference resides in that, since the base plate portion of the boss upper portion is as thick as its surrounding portion, the entire boss side surface of the cavity 1*d* is defined by the die insert 11 and the entire bottom surface (i.e., the entire boss side surface of the cavity 1*d*) is pressurized by the die insert 1. This arrangement provides similar advantageous results to those of the above embodiment.

While only a single slidable die insert is disposed for one cavity in this embodiment, a plurality of die inserts may equally be used and, by providing a plurality of die inserts and pressure-applying means which suitably pressurize the portion in which the shrink cavities are otherwise generated due to the cavity configuration, the generation of the shrink cavity can be more effectively prevented.

As has been described, according to the present invention, the method for manufacturing a casting by injecting and solidifying a molten metal within a cavity of a die is characterized by the steps of defining the cavity by a top die and a bottom die of the die and a die insert slidable relative to at least one of the top and bottom dies, moving the die insert rearward before injection to enlarge the cavity, and moving the die insert forward under a pressure equal to or less than an injection pressure before solidifying the molten metal within a gate portion for introducing the molten metal into the cavity, so that the molten metal does not flow reversely from the gate and, when the solidification in the cavity portion progresses and begins to shrink, the die insert starts to move forward due to the pressure applied on the die insert and applies a pressure to the molten metal within the cavity to reduce the volume of the cavity without impeding the forward movement of the die insert, thereby preventing shrink cavities. Therefore, a defect-free, quality cast product can be manufactured even with a small-dimension gate, so that the gate cutting at a subsequent step can be very easily achieved and the cut allowance for finishing can be made small. Also, the limitation of the configuration of the thin-walled portion of the product is significantly moderated and the degree of freedom is advantageously increased.

Also, since the pressure on the die insert is increased above the injection pressure after gate solidification at a suitable timing, the reverse flow of the molten metal is prevented and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, the cavity volume is increased by an amount corresponding to shrinkage of the molten metal by moving the die insert rearward before the injection, the dimensions of the cast product which shrinks during the solidification can be finished at desired dimensions.

Also, the method for manufacturing a casting by injecting and solidifying a molten metal within a cavity of a die is characterized by the steps of defining the cavity by a top die and a bottom die of the die and a die insert slidable relative to at least one of the top and bottom dies, moving the die insert rearward during injection to enlarge the cavity, and moving the die insert forward under a pressure equal to or less than an injection pressure before solidifying the molten metal within a gate portion for introducing the molten metal into the cavity, so that the molten metal does not flow reversely from the gate and, when the solidification in the cavity portion progresses and begins to shrink, the die insert starts to move forward due to the pressure applied on the die insert and applies a pressure to the molten metal within the cavity to reduce the volume of the cavity without impeding the forward movement of the die insert, thereby preventing shrink cavities. Therefore, a defect-free, quality cast product can be manufactured even with a small-dimension gate.

Also, since the pressure on the die insert is increased above the injection pressure after gate solidification at a suitable timing, the reverse flow of the molten metal is prevented and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, since the cavity volume is increased by an amount corresponding to shrinkage of the molten metal by moving the die insert rearward during injection, the dimensions of the cast product which shrinks during the solidification can be finished at desired dimensions.

Also, according to the present invention, the method for manufacturing a casting by injecting and solidifying a molten metal within a cavity of a die is characterized by the steps of defining the cavity by a top die and a bottom die of the die and a die insert slidable relative to at least one of the top and bottom dies, and applying a pressure equal to or less than an injection pressure toward the cavity to the die insert before injection, so that there is no need to determine the timing at which the die insert should be pressurized, there is not time delay in applying the pressure, the molten metal within the cavity portion is always maintained under pressure and the pressure application can be continuously achieved until the complete solidification. Therefore, a defect-free, quality cast product can be manufactured even with a small-dimension gate.

Also, since the pressure on the die insert is increased above the injection pressure after gate solidification at a suitable timing, the reverse flow of the molten metal is prevented and a defect-free, high-density cast product can be manufactured. Also, even when the injection pressure cannot be made high for a structural reason of the apparatus, a high pressure can be applied to the cavity portion, so that the cast product can be manufactured without being limited by the injection capacity of the apparatus main body.

Also, since the cavity volume is increased by an amount corresponding to shrinkage of the molten metal upon solidification by moving the die insert rearward during the injection, the dimensions of the cast product which shrinks during the solidification can be finished at desired dimensions.

Also, since the die insert is forwardly movable by an amount corresponding to shrinkage of the molten metal upon solidification and the die insert is maintained at a predetermined position, so that the dimensions of the cast product which shrinks during the solidification can be finished at a higher precision.

Also, since the thick-wall portion of a cavity having a thick-wall portion and a thin-wall portion is defined by a die insert, the die insert can be smoothly moved forward under pressure without impeding the forward movement of the die insert by the thin-wall portion which solidifies quickly, whereby a defect-free, quality cast product can be manufactured even with a small-dimension gate.

Further, according to the present invention, the provision is made of means for stopping the forward movement of the die insert at a predetermined position and pressure means for applying a pressure to the die insert, so that the molten metal can be easily and smoothly filled within the cavity and the cavity volume can be maintained to be not smaller than the product (casting).

Also, according to the present invention, the provision is made of drive means for driving the second die insert to push and separate from the die the cast product which stays on the die on which the die insert is disposed, so that the cast product can be easily taken out from the die including the die insert, eliminating the plastic deformation during the separation and providing a product having a good appearance.

What is claimed is:

1. A method for manufacturing a casting by injecting and solidifying a molten metal within a cavity of a die, the cavity being defined at least in part by a first die, a second die, and a die insert slidable relative to one of said first and second dies, said die insert being coupled to means for applying pressure, the method including the steps of:

moving said die insert rearward to enlarge said cavity, injecting molten metal into said cavity under an injection pressure after the step of moving said die insert rearward, and moving said die insert forward by engaging said pressure applying means under a pressure equal to or less than an injection pressure before the molten metal solidifies at a gate portion through which the molten metal is introduced into said cavity.

2. A method for manufacturing a casting as claimed in claim 1, further including a step of increasing said pressure on said die insert by said pressure applying means above said injection pressure after gate solidification.

3. A method for manufacturing a casting as claimed in claim 1, wherein the size of said cavity increases by an amount corresponding to shrinkage of said molten metal when the molten metal is injected.

4. A method for manufacturing a casting as claimed in claim 1, further including a step of providing said die insert having a thick-wall portion so that said cavity has a thick-wall portion and a thin-wall portion.

5. A method for manufacturing a casting by injecting and solidifying a molten metal within a cavity of a die, the cavity being defined at least in part by a first die, a second die, and a die insert slidable relative to at least one of said first and second dies, said die insert being coupled to means for applying pressure, the method including the steps of:

moving said die insert rearward to enlarge said cavity, injecting molten metal into said cavity under an injection pressure during the step of moving said die insert rearward, and moving said die insert forward by engaging said pressure applying means under a pressure equal to or less than an injection pressure before the molten metal solidifies within a gate portion through which the molten metal is introduced into said cavity.

6. A method for manufacturing a casting as claimed in claim 5, further including a step of increasing said pressure on said die insert by said pressure applying means above said injection pressure after gate solidification.

7. A method for manufacturing a casting as claimed in claim 5, wherein the size of said cavity increases by an amount corresponding to shrinkage of said molten metal when the molten metal is injected.

8. A method for manufacturing a casting as claimed in claim 5, further including a step of providing said die insert having a thick-wall portion so that said cavity has a thick-wall portion and a thin-wall portion.

9. A method for manufacturing a casting by injecting and solidifying a molten metal within a cavity of a die, the cavity being defined by a first die, a second die, and a die insert that is slidable relative to the first die, the molten metal being injected into the cavity under an injection pressure the method including the steps of:

applying to said die insert a pressure equal to or less than an injection pressure toward said cavity before injection, and injecting molten metal into said cavity at the injection pressure while said pressure is being applied to said die insert.

10. A method for manufacturing a casting as claimed in claim 9, further including a step of increasing said pressure on said die insert so that said pressure is greater than said injection pressure after said molten metal begins to solidify at a gate of the cavity.

11. The method of claim 9, wherein the applying step includes applying a pressure of at least about 500 atmospheres.

12. The method of claim 10, wherein said pressure is increased to at least about 1000 atmospheres.

13. A method for manufacturing a casting as claimed in claim 9, the size of said cavity increases by an amount corresponding to shrinkage of said molten metal when said molten metal is injected.

14. A method for manufacturing a casting as claimed in claim 9, further including a step of maintaining said die insert at a predetermined position during the injecting step.

15. A method for manufacturing a casting as claimed in claim 9, further including a step of providing said die insert shaped and sized so that said cavity has a thick-wall portion and a thin-wall portion.

16. A method for manufacturing a casting by injecting and solidifying a molten metal within a cavity of a die, the cavity being defined by a first die, a second die, and a die insert that is slidable relative to the first die, the molten metal being injected into the cavity under an injection pressure, the method including the steps of:

moving the die insert rearward away from the cavity to enlarge the cavity;

injecting molten metal into the cavity at the-injection pressure;

detecting when the injecting step begins; and in response to the detection the injection step, engaging pressure applying means to controllably apply a forward pressure equal to or less than the injection pressure to the die insert.

17. An apparatus for manufacturing a casting by injecting and solidifying molten metal within a cavity, the apparatus comprising:

a first die, a second die, a die insert slidable relative to at least one of said first and second dies, said first and second dies and said die insert defining said cavity, means for stopping the forward movement of said die insert at a predetermined position, and pressure means coupled to said die insert for controllably applying a pressure to said die insert before, during, and after injection.

18. The apparatus of claim 17, further including means for limiting movement of the die insert in a direction toward the cavity.

19. The apparatus of claim 17, wherein the pressure means is controllable to provide a first pressure that is less than an injection pressure under which molten metal is injected, and for applying a second pressure that is greater than the injection pressure after gate solidification.

20. The apparatus of claim 17, further comprising an ejector assembly disposed within the die insert.

21. The apparatus of claim 20, further comprising means for driving the ejector assembly, the driving means being disposed within the pressure means.

22. The apparatus of claim 21, wherein the pressure means includes a ring-shaped hydraulic cylinder, and wherein the drive means includes a hydraulic cylinder.

23. The apparatus of claim 17, further comprising a second die insert for defining an inner diameter of a box, and ejector rings that are slidable relative to the second die insert.

24. An apparatus for manufacturing a casting by injecting and solidifying a molten metal within a cavity of a die, the apparatus comprising:

a first die, a second die, a first die insert slidable relative to at least one of said top and bottom dies, a second die insert slidably disposed on said first die insert, said first and second dies and said first and second die inserts for defining said cavity, means, coupled to said first and second die inserts, for simultaneously applying pressure to said first and second die inserts, and means for driving said second die insert.

* * * * *